US009384657B2

(12) United States Patent
Mullet et al.

(10) Patent No.: US 9,384,657 B2
(45) Date of Patent: Jul. 5, 2016

(54) ARCHITECTURAL COVERING CRADLE SYSTEM, MULTIFUNCTION REMOTE AND METHOD OF USE

(71) Applicant: Qmotion Incorporated, Pensacola, FL (US)

(72) Inventors: Willis Jay Mullet, Gulf Breeze, FL (US); Harry Edward Asbury, Holt, FL (US); Matthew Warren Kirkland, Cantonment, FL (US)

(73) Assignee: The Watt Stopper, Inc., Santa Clara, CA (US)

( * ) Notice: Subject to any disclaimer, the term of this patent is extended or adjusted under 35 U.S.C. 154(b) by 100 days.

(21) Appl. No.: 14/299,656

(22) Filed: Jun. 9, 2014

(65) Prior Publication Data

US 2014/0368322 A1 Dec. 18, 2014

Related U.S. Application Data

(60) Provisional application No. 61/834,464, filed on Jun. 13, 2013.

(51) Int. Cl.

| | |
|---|---|
| ***G08B 21/00*** | (2006.01) |
| ***G08C 17/02*** | (2006.01) |
| ***E05F 15/77*** | (2015.01) |

(52) U.S. Cl.

CPC ..... *G08C 17/02* (2013.01); *E05F 15/77* (2015.01); *E05Y 2400/66* (2013.01); *E05Y 2400/81* (2013.01); *E05Y 2900/106* (2013.01); *E05Y 2900/132* (2013.01); *E05Y 2900/148* (2013.01); *G08C 2201/30* (2013.01)

(58) Field of Classification Search

CPC . E05F 15/77; E05Y 2400/66; E05Y 2400/81; E05Y 2900/148; G08C 17/02; G08C 2201/30

USPC ..... 340/12.5

See application file for complete search history.

(56) References Cited

U.S. PATENT DOCUMENTS

| | | | | |
|---|---|---|---|---|
| 4,815,683 | A | 3/1989 | Ferrante | |
| 4,956,588 | A * | 9/1990 | Ming | E06B 9/70 160/331 |
| D322,244 | S | 12/1991 | Bishai | |
| 5,082,229 | A | 1/1992 | Dahl | |
| 5,244,173 | A | 9/1993 | Kulyk | |
| 5,264,761 | A | 11/1993 | Johnson | |

(Continued)

FOREIGN PATENT DOCUMENTS

| | | | |
|---|---|---|---|
| EP | 0482252 | A1 | 4/1992 |

*Primary Examiner* — Mark Rushing

(74) *Attorney, Agent, or Firm* — Christopher A. Proskey

(57) ABSTRACT

A multi-function remote control and cradle system is presented. The remote fits within the opening of a standard light-switch faceplate and is magnetically held within a cradle which is connected to a conventional electrical box in the wall. The remote control includes a dwell function wherein when a button is pressed for less than a predetermined amount of time a first signal is sent, wherein when a button is pressed for more than a predetermined amount of time a second signal is sent. The remote control also includes a plurality of scene buttons wherein when pressed a plurality of architectural coverings are moved to a predetermined position. The remote control also includes a channel selector and a jog function wherein a unique signal is sent for each jog position between a fully open position and a fully closed position.

16 Claims, 7 Drawing Sheets

(56) References Cited

U.S. PATENT DOCUMENTS

| | | | | |
|---|---|---|---|---|
| 5,316,249 | A | 5/1994 | Anderson | |
| 5,341,941 | A | 8/1994 | Marlor | |
| 5,458,311 | A | 10/1995 | Holbrook | |
| 5,603,451 | A | 2/1997 | Helander et al. | |
| 5,648,757 | A | 7/1997 | Vernace et al. | |
| 5,790,021 | A | 8/1998 | Mickel et al. | |
| 6,085,826 | A | 7/2000 | Maesaki | |
| 6,305,656 | B1 | 10/2001 | Wemyss | |
| 6,320,503 | B1 | 11/2001 | Dunn et al. | |
| 6,355,885 | B1 | 3/2002 | Rintz et al. | |
| 6,522,078 | B1 | 2/2003 | Okamoto et al. | |
| 6,598,652 | B1 | 7/2003 | Montesinos Alonso | |
| 6,603,644 | B2 | 8/2003 | Yeh | |
| 6,751,486 | B1 | 6/2004 | Guillot et al. | |
| 6,769,658 | B2 | 8/2004 | Stokes | |
| 6,816,713 | B2 | 11/2004 | Chen | |
| 6,922,333 | B2 | 7/2005 | Weng et al. | |
| 6,967,565 | B2 | 11/2005 | Lingemann | |
| 6,983,126 | B1 | 1/2006 | Saalman | |
| D522,999 | S | 6/2006 | Smith-Adams et al. | |
| 7,071,836 | B2 | 7/2006 | Baud et al. | |
| 7,079,045 | B2 | 7/2006 | Baud et al. | |
| 7,187,283 | B2 | 3/2007 | Leyden et al. | |
| 7,284,791 | B1 | 10/2007 | Wright | |
| 7,372,355 | B2 | 5/2008 | Agronin et al. | |
| 7,499,261 | B2 | 3/2009 | Hash | |
| 7,639,907 | B2 | 12/2009 | Elberbaum | |
| 7,642,912 | B2 | 1/2010 | Sholem | |
| 7,723,939 | B2 | 5/2010 | Carmen, Jr. | |
| 7,864,500 | B2 | 1/2011 | Elberbaum | |
| 8,330,638 | B2 | 12/2012 | Altonen et al. | |
| 8,389,857 | B2 | 3/2013 | Petrillo | |
| 2002/0105763 | A1 | 8/2002 | Yeh | |
| 2003/0145958 | A1* | 8/2003 | Domel | G08C 19/28 160/168.1 R |
| 2004/0070516 | A1 | 4/2004 | Nielsen | |
| 2005/0034374 | A1 | 2/2005 | Ebbe et al. | |
| 2005/0168338 | A1 | 8/2005 | Parker et al. | |
| 2006/0250764 | A1 | 11/2006 | Howarth et al. | |
| 2007/0035917 | A1 | 2/2007 | Hotelling et al. | |
| 2007/0279245 | A1 | 12/2007 | Sholem | |
| 2008/0232061 | A1 | 9/2008 | Wang et al. | |
| 2009/0103228 | A1 | 4/2009 | Elderbaum | |
| 2009/0193717 | A1 | 8/2009 | Ebbe et al. | |
| 2009/0251352 | A1 | 10/2009 | Altonen et al. | |
| 2012/0193035 | A1* | 8/2012 | Malekpour | E06B 9/36 160/5 |
| 2012/0261078 | A1* | 10/2012 | Adams | E06B 9/32 160/6 |
| 2014/0091912 | A1* | 4/2014 | Lazarro | G08C 19/00 340/12.52 |

* cited by examiner

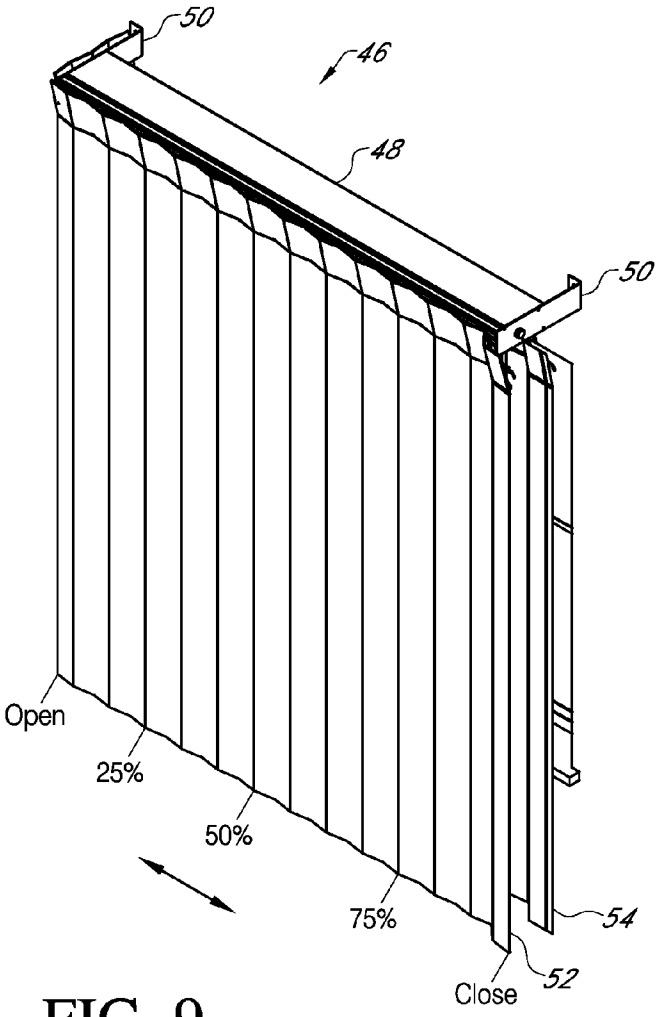
FIG. 9
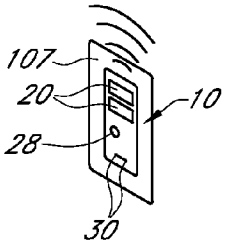

ARCHITECTURAL COVERING CRADLE SYSTEM, MULTIFUNCTION REMOTE AND METHOD OF USE

CROSS REFERENCE TO RELATED APPLICATION

This application claims the benefit of U.S. Provisional Application No. 61/834,464 filed Jun. 13, 2013.

FIELD OF THE INVENTION

This invention relates to a remote control. More specifically, and without limitation, this invention relates to a multi-function remote control and a cradle system for holding the remote.

BACKGROUND OF INVENTION

Remote controls are old and well known in the art. Conventional remote controls have been utilized to remotely control countless electronic devices such as garage doors, television sets and door locks on vehicles to name a few. While the capability, range, durability and functionality of remote controls have improved over time substantial deficiencies still exist in the art. Namely, remotes are often lost, or misplaced because there is no convenient area to place or hold conventional remotes. Another deficiency with current remote technology is that conventional remote control technology lacks the capability to control new electronic devices, such as new motorized architectural coverings, in a manner that suits the ever increasing demands of the consumer.

Architectural coverings, such as curtains, shades, draperies and the like are frequently used to provide privacy and to limit the amount of light that is permitted to pass through a window and into a room or building. There are countless types, forms and designs of architectural coverings known in the art. The term architectural covering is used to describe any and all of these types, forms and designs including blinds, shades, draperies, and the like.

One form of architectural covering of particular interest in this application is a roll shade (hereinafter "roll shade"). Common components of roll shades include a roll tube rotatably connected to brackets on opposing ends. The roll shade is positioned above or adjacent to a window or door. In one arrangement of a roll shade, shade material is wrapped around the roll tube and connected to a bottom bar, as the roll tube rotates the shade material is wrapped or unwrapped around the roll tube thereby opening and closing the roll shade.

Another form of architectural covering of particular interest in this application is a honeycomb shade and Venetian shade (hereinafter "honeycomb shade" and "venetian shade"). Common components of honeycomb shades and Venetian shades include a header and a bottom bar with shade material extending therebetween. In the case of a honeycomb shade a single panel of material extends between the header and the bottom bar whereas in the case of a Venetian shade a plurality of slats are held within a ladders that extend between the header and the bottom bar. Both honeycomb shades and Venetian shades have suspension cords that extend from the header to the bottom bar. These suspension cords are connected to a drive mechanism, which when actuated raise and lower the bottom bar by winding or unwinding the suspension cords.

Yet another form of architectural covering of particular interest in this application is a drapery shade (hereinafter "drapery"). Common components of drapery include a support rod connected at its ends to brackets and shade material connected to and hanging down from the support rod. Drapery shades can include blackout shades and shear shades which can be independently opened and controlled by laterally sliding them along the support rod.

Recent improvements in motorization and motor control technologies have allowed manufacturers to motorize these various architectural coverings in new ways. While the motorization of architectural coverings has provided certain advantages, one deficiency is that conventional remote control technology does not provide the ability to sufficiently manipulate and control these improved motorized architectural coverings.

Thus it is a primary object of the invention to provide a system and method at using remote controls to manipulate architectural coverings that improve upon the state of the art.

Another object of the invention is to provide a system and method of using remote controls to manipulate architectural coverings that is easy to use.

Yet another object of the invention is to provide a system and method of using remote controls to manipulate architectural coverings that is efficient.

Another object of the invention is to provide a system and method of using remote controls to manipulate architectural coverings that is simple in design.

Yet another object of the invention is to provide a system and method of using remote controls to manipulate architectural coverings that is inexpensive.

Another object of the invention is to provide a system and method of using remote controls to manipulate architectural coverings that has a minimum number of parts.

Yet another object of the invention is to provide a system and method of using remote controls to manipulate architectural coverings that has an intuitive design.

Another object of the invention is to provide a system and method of using remote controls to manipulate architectural coverings that provides for storage of remote controls in an aesthetically pleasing manner.

Yet another object of the invention is to provide a system and method of using remote controls to manipulate architectural coverings that provides improved functionality.

Another object of the invention is to provide a system and method of using remote controls to manipulate architectural coverings that improves the accuracy of control.

Yet another object of the invention is to provide a system and method of using remote controls to manipulate architectural coverings wherein the remote has a minimum number of buttons.

Another object of the invention is to provide a system and method of using remote controls to manipulate architectural coverings that provides in a convenient and secure place to hold the remote.

Yet another object of the invention is to provide a system and method of using remote controls to manipulate architectural coverings that utilizes standard parts and components where possible.

These and other objects, features, or advantages of the present invention will become apparent from the specification and claims.

SUMMARY OF THE INVENTION

A multi-function remote control and cradle system is presented wherein the remote control is of a small stature and fits within the opening of a standard light-switch faceplate. The remote control is magnetically held within a cradle which can be connected to a conventional electrical box or any other type of recess in the wall so as to avoid unintentional dislodgement, while still being removable. The remote control includes a dwell function wherein when the button is pressed for less than a predetermined amount of time a first signal is sent, wherein when the remote control is pressed for more than a predetermined amount of time a second signal is sent. The remote control also includes a plurality of scene buttons wherein when pressed a plurality of architectural coverings are moved into a predetermined position. The remote control also includes a channel selector. The remote also includes a jog function wherein a unique signal is sent for each jog position between a fully open position and a fully closed position.

BRIEF DESCRIPTION OF THE DRAWINGS

FIG. 9 is a perspective view of a drapery architectural covering having a black out shade and a sheer shade, the drapery controlled by the remote positioned within a cradle, held within a lite switch face plate.

DETAILED DESCRIPTION OF THE INVENTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that mechanical, procedural, and other changes may be made without departing from the spirit and scope of the invention(s). The following detailed description is therefore, not to be taken in a limiting sense, and the scope is defined only by the appended claims, along with the full scope of equivalents to which such claims are entitled.

As used herein, the terminology such as vertical, horizontal, top, bottom, front, back, end and sides are referenced according to the views presented. It should be understood, however, that the terms are used only for purposes of description, and are not intended to be used as limitations. Accordingly, orientation of an object or a combination of objects may change without departing from the scope of the invention.

As used herein, the invention is shown and described as being used in association with an architectural covering however the invention is not so limiting. Instead, one of ordinary skill in the art will appreciate that the system and method presented herein can be applied to any mechanical device, without limitation. The system and method is merely shown and described as being used in association with an architectural covering for ease of description and as one of countless examples.

As used herein, the term architectural covering refers to any covering such as a blind, drapery, roller shade, venetian blind or the like, used especially in association with windows. This term is in no way meant to be limiting. Instead, one of ordinary skill in the art will appreciate that the system and method presented herein can be applied to any architectural covering, without limitation.

Figure 1:
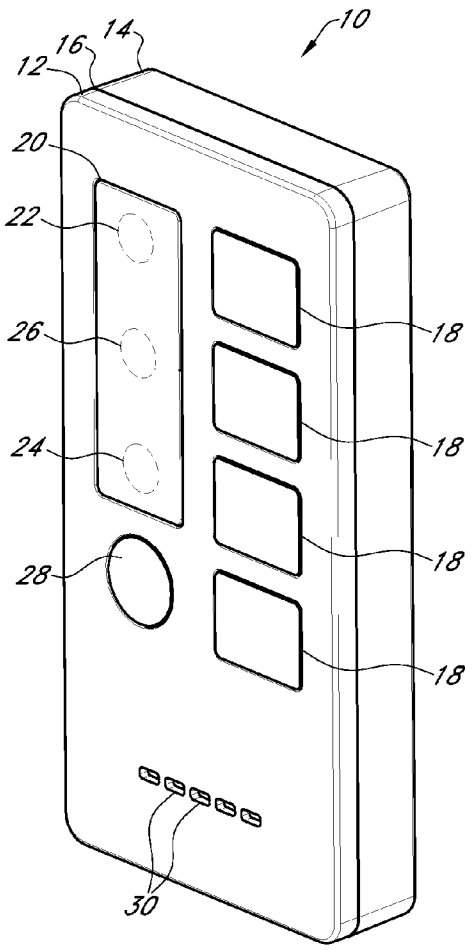
FIG. 1 is a perspective view of a first remote having a first vertically aligned paddle button, a plurality of push buttons, a plurality of indicator lights and a select button.

With reference to FIG. 1, a remote control 10 is presented. Remote control 10 has a front cover 12 and a rear cover 14 which connect together to one another in a clamshell-type fashion along a seam line 16 therebetween. Remote 10 is formed of any suitable size, shape and design. In one arrangement, as is shown, remote 10 is generally flat and rectangular in shape with a planar front surface and a planar rear surface which extend in approximate parallel spaced relation to one another. Remote 10 also includes sidewalls that extend in approximate parallel spaced relation which are generally square to the front and rear surfaces and top and bottom walls which are generally square to the front and rear surfaces and are generally square to the sidewalk and extend in approximate parallel spaced relation to one another. As is shown, remote 10 also includes rounded corners and edges for improved aesthetics.

Remote 10 includes a plurality of push buttons 18, in the arrangement shown, push buttons 18 are generally square or rectangular in shape and are positioned vertical alignment with one another along the right side, or alternatively the left side, of the front face of remote 10. In this arrangement four push buttons 18 are shown, however more or less push buttons 18 may be utilized such as one, two, three, five, six, ten, or more.

Remote 10 also includes at least one paddle button 20. In the arrangement shown, paddle button 20 is generally an elongated rectangular shape which is aligned in vertical alignment along the left side of the front face of remote 10, or alternatively along the right side. In this arrangement, paddle button 20 extends in generally parallel spaced relation to the stack of push buttons 18. Due to its elongated vertical alignment, paddle button 20 lends itself well in the user's mind to vertical actuation of architectural coverings, that is vertically opening and closing roller shades, venetian shades and/or honeycomb shades; whereas push buttons 18 lend themselves well in the user's mind to corresponding positions, with the higher the position of the push button 18 on the remote 10, the higher the corresponding position the push button 18 is associated with on a motorized architectural covering.

Paddle button 20 has a plurality of zones for actuation. That is, when different zones of paddle button 20 are pressed different signals are sent by remote 10. In one arrangement, paddle button 20 has an up zone 22 which is located approximately around the upper region of paddle button 20. Paddle button 20 also has a down zone 24 which is located approximately around the lower region of paddle button 20. Paddle button 20 can also include any number of other zones between up zone 22 and down zone 24, such as middle zone 26 located approximately in the middle of paddle button 20. In one arrangement, when actuated the up zone 22 sends an up or open signal to an architectural covering, when actuated the down zone 24 sends a down or close signal to the architectural covering, and when actuated the middle zone 26 sends a move to somewhere between an open position and a close position such as 50% open, 25% open, 75% open or any other preprogrammed position. In one arrangement, various symbols are placed on or associated with the various zones 22, 24, 26 to indicate to the user what that particular zone is used for, such as an up arrow, down arrow, or the like.

Remote 10 also includes a select button 28. In the arrangement shown, select button 28 is oval or round in shape and is positioned below the paddle button 20 opposite the stack of push buttons 18. The select button 28 is shaped in a different shape than the other buttons 18, 20 so as to indicate a different function. In one arrangement, when remote 10 is a multi-channel remote used to independently control a plurality of devices each of which operate on a unique or independent channel or have a unique identification number that remote 10 uses to control the each device, select button 28 is used to select the channel the remote 10 will communicate on or transmit signals using. Or said another way, select button 28 is used to select or toggle between the various channels used to control various devices.

In one arrangement indicators 30 are associated with each channel selected. Indicators 30 are of any size, shape and design. In one arrangement, as is shown, indicators are a row of lights, LEDs or the like which are positioned in a lateral alignment in the front face of remote 10 adjacent the bottom end of remote 10, or alternatively they are positioned along the top. In one arrangement, as the select button 28 is selected, the light or LED associated with the selected channel will illuminate. In this way, the user can select which channel the remote 10 will communicate on. In one arrangement, each time a button is pressed, the indicator 30 selected illuminates. In another arrangement, the remote 10 includes a motion sensor, such as an accelerometer or motion sensor, that senses when the remote is being moved and in response the selected indicator 30 illuminates. In one arrangement, remote 10 includes a setting selectable by select button 28 where all channels are selected simultaneously, and corresponding thereto all the indicators 30 illuminate.

Figure 8:
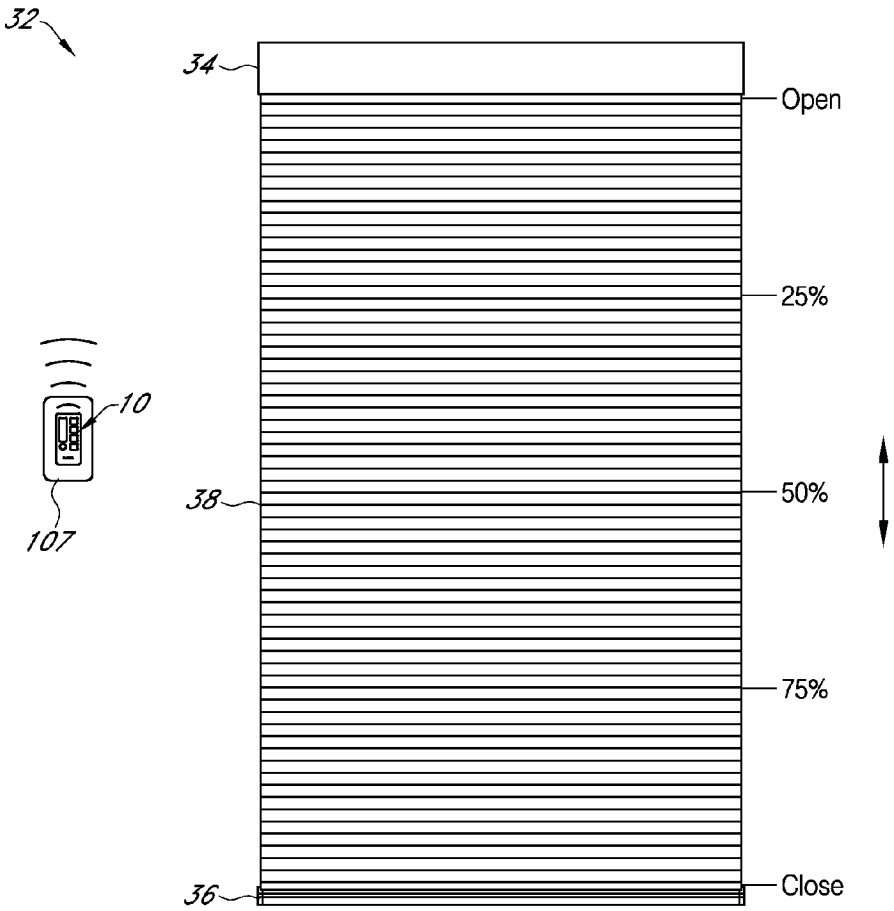
FIG. 8 is a front elevation view of a honeycomb shade in a closed position, the honeycomb shade controlled by the remote positioned within a cradle held within a lite switch face plate.

The remote 10 of FIG. 1 is well suited to control one or more architectural coverings 32 that vertically open and close such as roller shades, venetian shades, honeycomb shades, or the like. As one example, a honeycomb shade 32 is shown in FIG. 8 includes a header 34, a bottom bar 36 and shade material 38 which extends therebetween. The honeycomb shade 32 is shown in an open position and the remote 10 is used to control the vertical position of the bottom bar 36.

Figure 2:
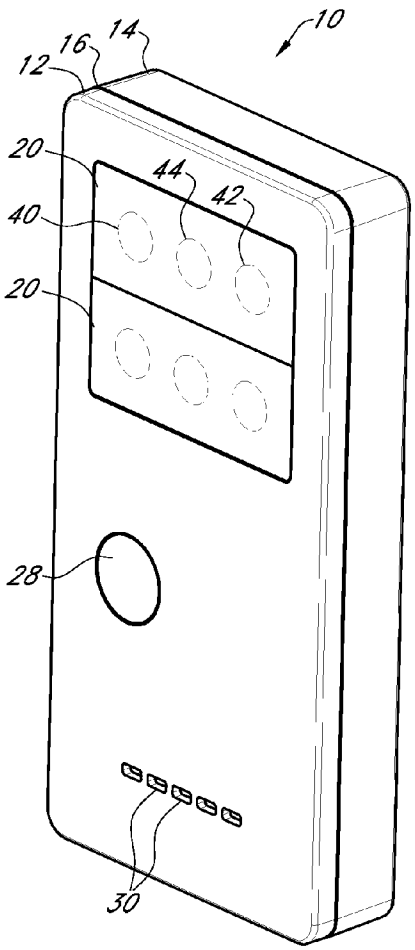
FIG. 2 is a perspective view of a second remote having a pair of horizontally aligned paddle button, a plurality of indicator lights and a select button.

In an alternative arrangement, as is shown in FIG. 2, remote 10 which is similar if not identical in size, shape and design as that depicted in FIG. 1 and discussed previously, has a pair of horizontally aligned paddle buttons 20. In this arrangement, paddle buttons 20 extends in generally parallel spaced relation to one another, and extend across the upper end of front face of remote 10. Due to the elongated horizontal alignment of these paddle buttons 20, they lends themselves well in the user's mind to horizontal actuation of architectural coverings, that is opening and closing shades or draperies which open from side-to-side.

These horizontally aligned paddle buttons 20 also have a plurality of zones for actuation. That is, when different zones of paddle button 20 are pressed different signals are sent by remote 10. In one arrangement, paddle button 20 has a left zone 40 which is located approximately around the left region of paddle button 20. Paddle button 20 also has a right zone 42 which is located approximately around the right region of paddle button 20. Paddle button 20 can also include any number of other zones between left zone 40 and right zone 42, such as middle zone 44.

The two vertically stacked and horizontally aligned paddle buttons 20 are well suited to actuate a motorized drapery 46 as is shown in FIG. 9. As one example, drapery 46 includes a support member 48 connected adjacent its ends to support brackets 50. A blackout curtain 52 and a shear curtain 54 hang down from support member 48. Blackout curtain 52 and shear curtain 54 slidably move along the length of support member 48 between an open and closed position. While the drapery 46 shown in FIG. 9 opens and closes from one side, in an alternative arrangement, the drapery 46 is center opening or closing.

In one arrangement, one of the paddle buttons 20 of the remote 10 shown in FIG. 2 is associated with the blackout curtain 52 whereas the other paddle button 20 is associated with the shear curtain 54. When actuated the left zone 40 of paddle button 20 sends a move left signal to appropriate curtain 52, 54 of drapery 46, when actuated the right zone 42 sends a move right signal to drapery 46, and when actuated the middle zone 44 sends a move to somewhere between an open position and a close position such as 50% open, 25% open, 75% open or any other preprogrammed position of the appropriate curtain 52, 54. In one arrangement, various symbols are placed on or associated with the various zones 40, 42, 44 to indicate to the user what that particular zone is used for, such as an left arrow, right arrow, or a close symbol or open symbol the like. In addition a symbol can be associated with each paddle button 20 to indicate whether it is associated with the blackout curtain 52, or the shear curtain 54.

Assembly of Remote:

Front cover 12 and rear cover 14 connect together in a clamshell like fashion along seam line 16 therebetween. In this way, front cover 12 and rear cover 14 form a hollow interior 56 therebetween in which the other components of remote 10 are housed and held. Front cover 12 and rear cover 14 are connected to one another by any means known in the art such as bolting, screwing, snapping, welding, adhesives, or the like.

In one arrangement, as is shown, to facilitate connection of front cover 12 and rear cover 14 to one another, a plurality of snap features 58 are positioned along an overlapping flange 60 which extends inwardly towards rear cover 14 from the exterior periphery of from cover 12. Flange 60 is positioned inward from step 62 in the exterior sidewall of front cover 12 which extend around the entire periphery of front cover 12. Snap features 58 are aligned with and snap features 64 in the inside surface of sidewall 66 of rear cover 14. Sidewall 66 extends around the periphery of rear cover 14 and extends towards front cover 12. In one arrangement, snap features 58 in front cover 12 are deflectable hook members protruding outwardly from flange 60, whereas snap features 64 in sidewall 66 of rear cover 14 are recesses sized and shaped to lockingly receive and hold the snap features 58 of front cover 12.

A PC board 68 is positioned between and held by front cover 12 and rear cover 14. PC board 68 is formed of any suitable size, shape and design. In one arrangement, as is shown, PC board 68 is a generally rectangular shape which takes up the majority of the area within hollow interior 56. PC board 68 is generally planar in shape having a thin cross section.

Figure 3:
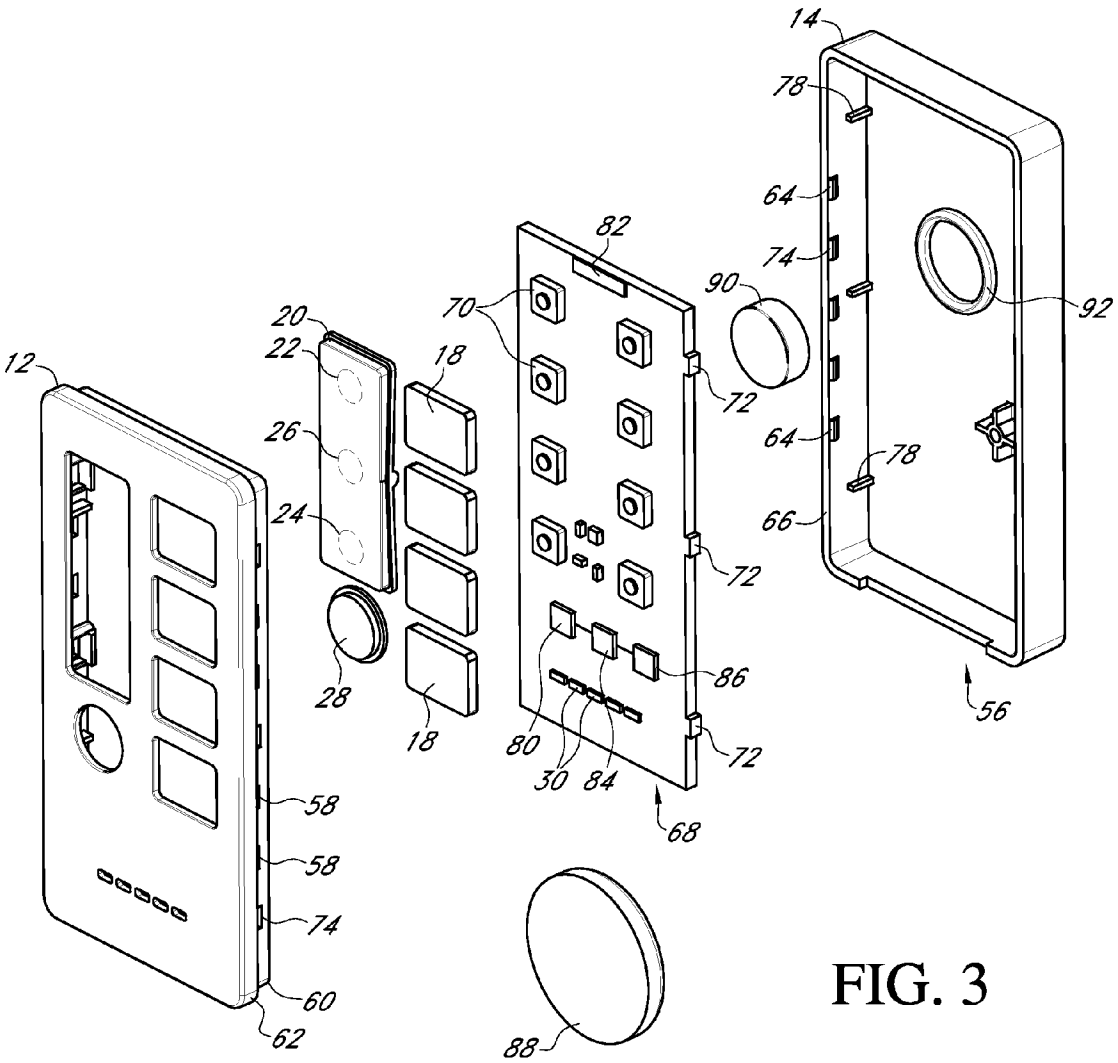
FIG. 3 is an exploded perspective view of the first remote of FIG. 1
Figure 4:
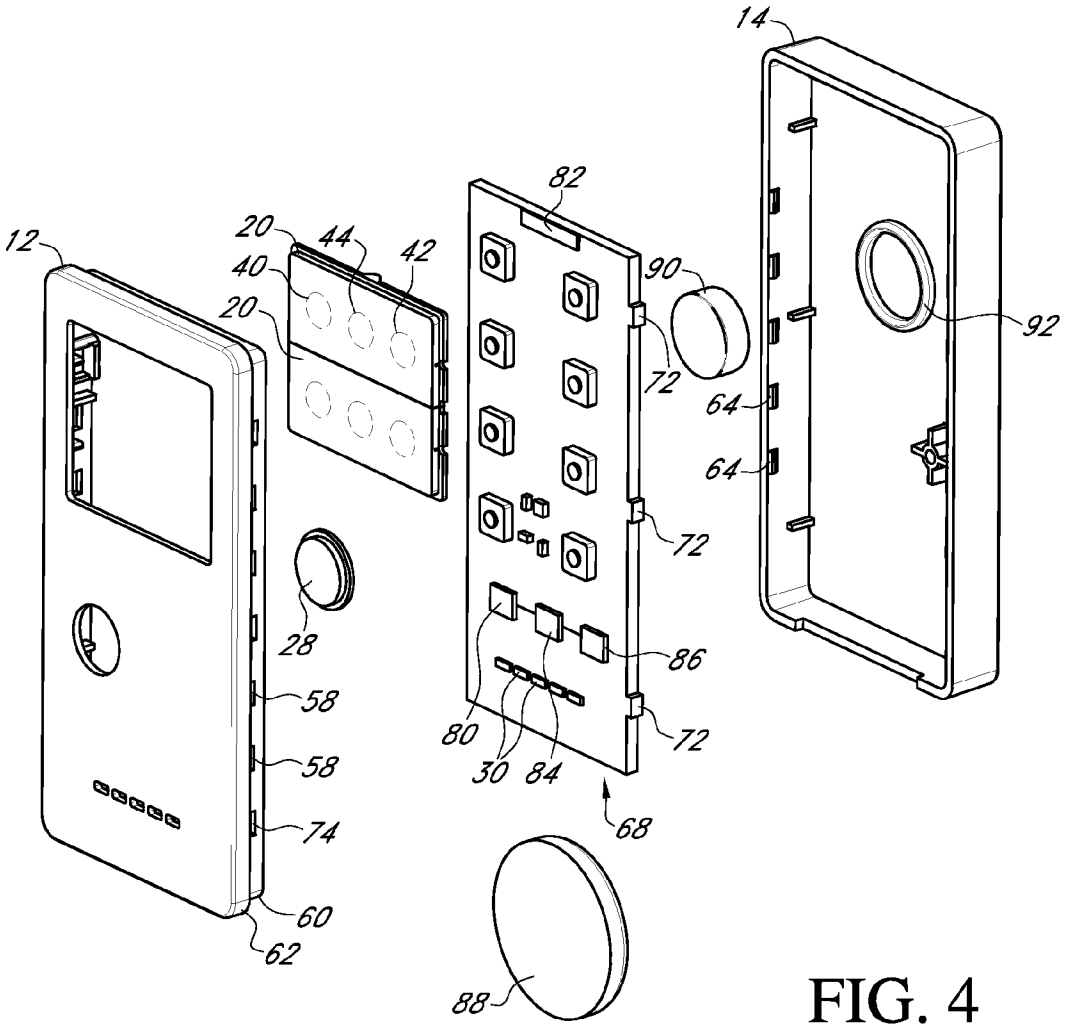
FIG. 4 is an exploded perspective view of the second remote of FIG. 2.
Figure 6:
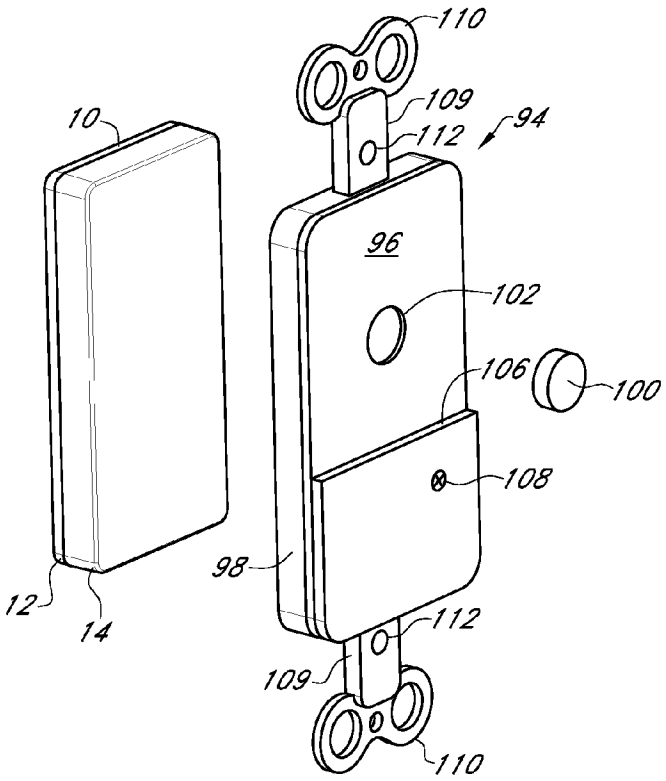
FIG. 6 is a back side perspective view of FIG. 8 showing the first remote positioned just outside of the cradle as if it was just removed or about to be inserted therein.
Figure 5:
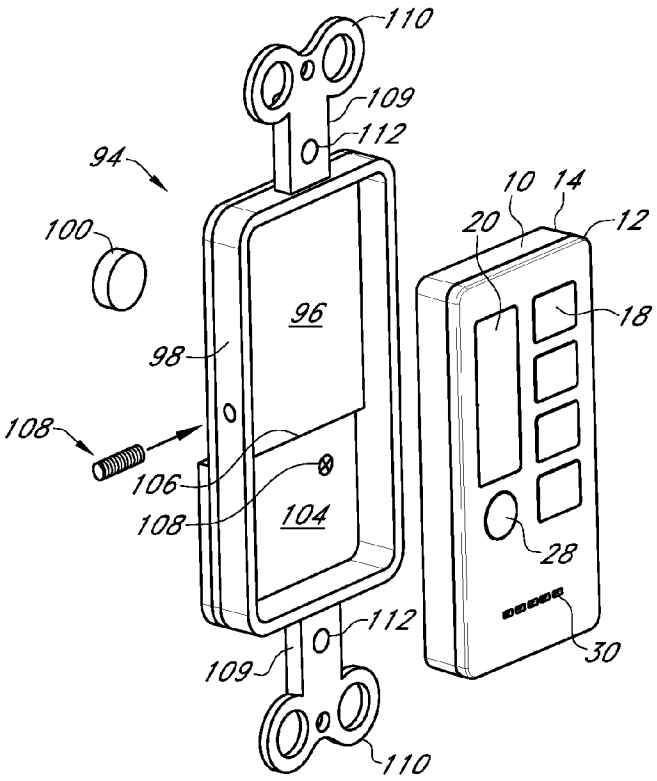
FIG. 5 is a perspective view of the first remote positioned just outside of the cradle, the view showing the remote in a tilted position as if it had just been tilted into the tilting recess and then removed.

A plurality of sensors 70 are positioned in the front face of pc board 68 and are aligned with each of the buttons 18, 20, 28 of remote 10. With respect to the push buttons 18 and select button 28 only a single sensor 70 is associated with these buttons 18, 28. With respect to paddle buttons 20 more than one sensor 70 is associated with the paddle button 20. In the arrangement shown in FIG. 3, three sensors 70 are associated with the paddle button 20; one for the up zone 22, one for the down zone 24 and one for the middle zone 26 in a three-zone paddle arrangement. However, in an alternative arrangement, the middle sensor 70 is inert or inactive. In such an arrangement, paddle button 20 only has an up zone 22 and a down zone 24.

Figure 7:
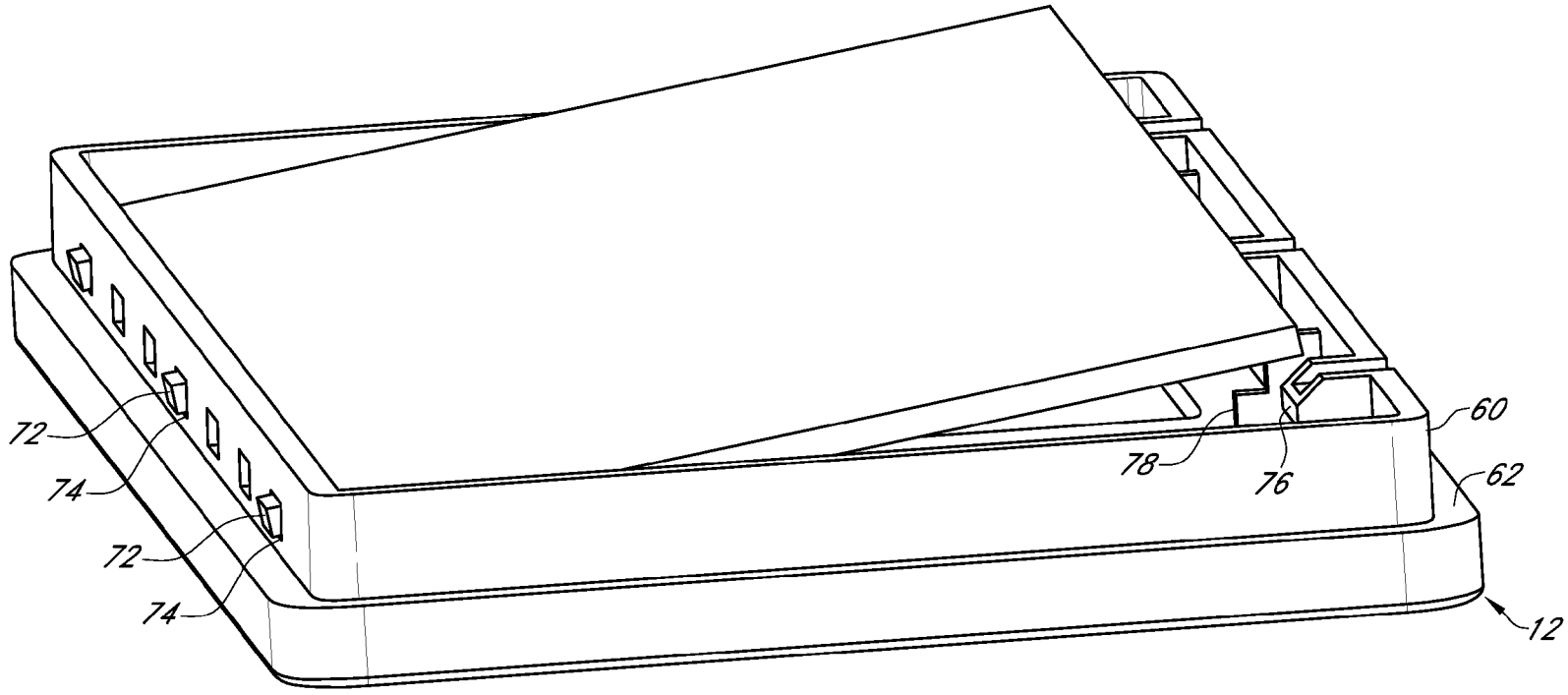
FIG. 7 is a perspective view of a PC board having tabs therein about to be inserted into the housing of a remote with the tabs aligned with openings in the housing of the remote, the view also showing the rests in the housing that the PC board sits upon.

One manner of holding PC board 68 between front cover 12 and rear cover 14 is by closely and tightly sizing and shaping PC hoard to fit therein such that when the front cover 12 and rear cover 14 are connected to one another PC board 68 is lockingly sandwiched therebetween in fight frictional engagement. To provider further strength, rigidity and robustness to the design a plurality of tabs 72 protrude out of the periphery of PC board 68. These tabs 72 are received within openings 74 positioned within the flange 60 of front cover 12, or alternatively openings 74 are positioned within the sidewall 66 of rear cover 14. A plurality of PC board connectors 76 are positioned opposite openings 74 which are sized and shaped to engage an edge of the PC board 68 opposite tabs 72 and snappingly and lockingly hold the PC board 68 therein or thereunder. In the arrangement shown in FIG. 7 PC board connectors 76 have an angled upper edge which facilitates the PC board 68 sliding there past while the PC board connectors 76 are deflected such that the PC board 68 is held within a groove or arm or space below the PC board connectors 76. When in place within PC board connectors 76, the back side of PC board 68 sits on or rests upon a shelf or rest 78 thereby holding PC board 68 in the proper position within hollow interior 56. The support provided by rests 78 add rigidity to PC board 68 which helps to prevent PC board 68 from when the buttons are pressed. This provides a more solid feel and helps to ensure that when a button is pressed the associated sensor 70 is activated.

PC board 68 includes all the necessary componentry to operate remote 10 including a receiver or transceiver 80, an antenna 82, a microprocessor 84, memory 86 and any other component needed, all of which is electrically connected through and supported b PC board 68. A power supply 88 is also connected to PC board 68. In one arrangement, power supply 88 is a battery, however any other form of power is hereby contemplated such as a solar cell or the like.

A magnet 90 is positioned within the hollow interior 56 of remote 10. In one arrangement, magnet 90 is sized and shaped to be received within magnet recess 92 positioned within the interior surface of rear cover 14 at or around the upper region of remote 10. In one arrangement, recess 92 is closely sized and shaped to magnet 90 such that magnet 90 is held therein by frictional forces. Alternatively or in addition, magnet 90 is held within recess 92 with the use of adhesives. In addition, magnet 90 is prevented from escaping, recess 92 once PC board 68 is snapped into place on rests 78 below PC board connectors 76. In an alternative arrangement, magnet 90 is formed within the material of rear cover 14, thereby permanently preventing the escape of magnet 90 short of breaking the cover 14.

Cradle:

Remote 10 is sized and shaped to removably and replaceably fit within cradle 94. Cradle 94 is formed of any suitable size, shape and design. In one arrangement, as is shown, cradle 94 has a back wall 96 with a sidewall 98 extending around the periphery of back wall 96 and extending forward therefrom. Back wall 96 is generally flat and flush and matingly receives the rear side of rear cover 14 in planar face-to-face engagement. Similarly, sidewall 98 is sized and shaped to matingly receive the periphery of remote 10.

A magnet 100 is associated with cradle 94 and helps to hold remote 10 therein. In one arrangement, magnet 100 is positioned within a recess 102 in the back side of back wall 96. In one arrangement, recess 102 is closely sized and shaped to magnet 100 such that magnet 100 is held therein by frictional forces. Alternatively or in addition, magnet 100 is held within recess 102 with the use of adhesives. In an alternative arrangement, magnet 100 is formed within the material of cradle 94, thereby permanently preventing the escape of magnet 100 short of breaking the cradle 94.

The magnet 100 in cradle 94 is positioned in alignment with the magnet 90 of remote 10, making sure that the poles of magnets 90, 100, are aligned with one another. In this way, magnets 90, 100 provide a strong attractive force which holds remote 10 within cradle 94, which practically eliminates the possibility that remote 10 will ever unintentionally dislodge from cradle 94. In addition, this arrangement helps facilitate insertion of remote 10 into cradle 94 by attracting by magnetic force the remote 10 into the cradle 94 when the two components 10, 94 are moved close to one another. In the arrangement shown, the magnets 90, 100 are laterally centered on their respective remote 10 and cradle 94, however they are vertically offset. This vertical offset ensures that the remote 10 is inserted repeatably in the appropriate and consistent orientation, that is, with the top end at the top. In addition, by aligning the poles of the two magnets 90, 100, prevents the remote 10 from being placed in the cradle in the reverse orientation, that is with front cover 12 against the back wall 96 of cradle 94.

Also, a durable arrangement is presented because a layer of material is positioned between each of the magnets 90, 100 when they magnetically connect to one another. That is, the back wall o rear cover 14 and the back wall 96 of cradle 94 is positioned between the magnets 90, 100. This helps to attenuate some of the magnetic attraction by preventing direct magnet-on-magnet connection, allows for easier removal while still providing strong hold, and it causes the magnets 90, 110 to pull into their respective recesses 92, 102 instead, of out of these recesses 92, 102 thereby providing a more durable design.

Due to the strong attractive force between magnets 90, 100 when remote 10 is within cradle 94, removal of remote 10 can be difficult. To overcome these forces and aid in removal, a tilting recess 104 is positioned in the lower end of back wall 96 of cradle 94. Tilting recess 104 has a front face positioned rearward of the front face of back wall 96. A step 106 is positioned between or at the intersection of back wall 96 and tilting recess 104.

When remote 10 is in position within cradle 94 the rear planar surface of rear cover is in frictional engagement and planar alignment with the front planar surface of back wall 96 of cradle 94. In this position the sidewall 98 of cradle 94 extends around the exterior peripheral edge of remote 10. In this position, the two magnets 90, 100 which are aligned with one another have a strong magnetic attraction to one another thereby holding the remote 10 within cradle 94. To remove the remote 10, a user presses on the lower end of remote 10. This causes the body of the remote 10 to act like a lever and step 106 to act as the fulcrum. As the pressing force overcomes the magnetic attraction of the magnets 90, 100, the bottom of the remote enters the tilting recess 104 and the top of the remote 10 pops out slightly from the cradle 100. In this position, the user can easily grasp the upper end of the remote and remove it front the cradle 94.

In one arrangement, remote 10 and the opening in cradle 94 is sized and shaped to match standard large-sized light switches. This style of light switch is commonly known as a "Dechora" light switch which have become increasingly popular in recent years. By sizing and shaping remote 10 and cradle 94 to match the standard or conventional Dechora light switch socket, this enables the use of conventional light switch face plates 107 as well as the utilization of standard electrical boxes for mounting purposes.

More specifically, mourning brackets 109 extend outwardly from the top end and bottom end of cradle 94. These mounting brackets 109 have stabilizing ears 110 that extend outwardly from the mounting brackets 109 and help to provide stabilization for cradle 94 when connected to a conventional electrical box, such as is used in the walls of homes or offices. Brackets 109 also have secondary apertures 112 therein which are sized and shaped to receive screws for mounting of conventional face plates in a conventional manner.

Locking Feature:

In some arrangements, such as in hotels, public venues, rental properties or the like, it is desirable to prevent the remote 10 from being removed from the cradle 94 so as to prevent its loss. In these arrangements, there are a plurality of manners and methods of preventing the easy removal of remote 10 from cradle 94. In one arrangement, a locking screw 108 passes through the sidewall 98 of cradle 94 and engages the sidewall of remote 10 thereby frictionally preventing the remote 10 from being removed from cradle 94.

In another arrangement, locking screw 108 is positioned within the tilting recess 104 and can be screwed in and out thereof. In this arrangement, when the head of locking screw 108 protrudes into the tilting recess 104, this prevents the bottom end of remote 10 front tilting and essentially prevents removal of the remote from cradle 94 because a user cannot grasp any portion of the remote 10 and therefore it will remain in the cradle. In this arrangement, to allow removal of remote 10 from tilting recess 104, the locking screw 108 is simply screwed flat with the surface of tilting recess 104.

Jog Function:

In one arrangement, paddle buttons 20 are used to move architectural coverings a predetermined amount or predetermined distance between an open position and a closed position. As an example, the remote 10 depicted in FIG. 1 is associated with and learned to the honeycomb shade 32 shown in FIG. 8, the paddle button 20 can be used to move the honeycomb shade 32 any distance between the a closed position and an open position.

For purposes of example, honeycomb shade 32 begins in the closed position, and the user presses the up zone 22 of paddle button 20, remote 10 sends an up command to honeycomb shade 32. This command is received by an antenna of honeycomb shade 32, is transmitted to a transceiver, which transmits it to a microprocessor which processes the signal based on instructions stored in its memory. The microprocessor that sends control signals to a motor which moves the bottom bar to the instructed position.

The predetermined amount associated with each press of the paddle button 20 can include any percentage of the distance between an open position and a closed position such as 1%, 2%, 3%, 4%, 5%, 6%, 7%, 8%, 9%, 10%, 11%, 12%, 13%, 14%, 15%, 20%, 25%, 30%, or any other percentage of distance between the open position and the closed position. Alternatively the predetermined amount associated with each press of the paddle button 20 can include any predetermined distance such as ¼", ⅓", ½", ⅔", ¾", 1", 1&¼, 1&⅓", 1&½", 1&⅔", 1&¾", 2", 2&½", 3", 4", 5", 6", 7", 8", 9", 10", 12", 13", 14", 15", 20", 25", 30" or any other distance between the open position and the closed position.

In one arrangement, each time the paddle button 20 is pressed the same signal is sent. Said another way, each time the paddle button 20 is pressed, a signal is sent that informs the honeycomb shade 32 to move up a predetermined amount or predetermined distance. While this arrangement works, in a multiple shade environment there is a potential for shades to get out of sync with one another because the same signal is sent repeatedly and therefore if a signal is missed by a particular shade, that shade would have no reason to know it is not moving to the desired position.

That is, as an example, if the predetermined amount is 5% of the distance between open and closed. In this example there are 20 unique positions that are possible between open and closed by pressing the paddle button 20. If the user presses the paddle button 4 times the shades will move up 20%. To move up 20%, however, each shade must receive each of the four signals caused by pressing the paddle button 20. That is, each signal is identical and is equivalent to "Move up 5%"-"Move up 5%"-"Move up 5%"-"Move up 5%". If all four of these signals are received and properly interpreted by all of the window shades will move to 20% up from the closed position.

The problem is with this arrangement, however, if one of the shades misses or does not receive, or does not properly interpret one of the wireless signals, the shades will forever be out of sync or out of step with one another and will require fully opening or fully closing to get them back into sync with one another which is inconvenient and undesirable. Getting out of sync can happen for a multitude of reasons such as low battery strength, physical or electromagnetic interference, or distance from source, to name a few. The result is that the shade will be of from the others and there is no way to get it back into the same position as the other shades by using the jog function alone. Further, this the error caused by missing a signal can compound on top of itself when a plurality of jog function signals are sent, both up or down.

An improved method is to assign a unique signal for each jog position in an operating range between a fully open position and a fully closed position. That is, in the same example, if the predetermined amount is 5% then there are 20 possible jog positions between the open position and the closed position. A unique signal is assigned for each jog position. In this arrangement, the remote 10 and/or the architectural covering itself remembers the last position of the architectural covering. When a user presses the paddle button, the jog position is incremented (up or down, left or right depending on the remote and the application) and the unique signal is sent.

As an example, when the architectural covering is in a closed position and the remote 10 stores this position in its memory, when the user presses the up portion of the paddle button four times four different jog signals are sent. These signals are the equivalent of "Move to 95%"—"Move to 90%"-"Move to 85%"-"Move to 80%". Therefore, if one of the plurality of shades intended for the signal misses any or all of the first, second or third signals yet receives the fourth signal, all of the window shades 32 will be synced to one another at the 80% closed position. If one of the shades does miss the last signal, all the user has to do is hit the up jog button followed by the down jog button and all the shades should again be aligned in the desired position. In this way, the error of missing, a signal is not compounded.

The same arrangement is applicable to the remote 10 in FIG. 2 for use with horizontally moving drapes, shades or blinds, including a blackout shade and a sheer shade shown in FIG. 9.

Dwell Function:

In one arrangement, as is described herein, paddle buttons 20 are used to move architectural coverings a predetermined amount or predetermined distance by pressing and releasing the up zone 22 or down zone 24. In an alternative arrangement, paddle button 20 has multi-functionality. In this arrangement, paddle button 20 is time sensitive. In this arrangement, what signal is sent depends on the amount of time that a zone of paddle button 20 is pressed. When a zone of the paddle button 20 is depressed, sensors 70 send a signal to microprocessor 80 which determines what signal to send based on the length of depression of the button.

Two-Signals:

In one arrangement, when paddle button 20 is pressed for less than a first predetermined amount of time, a first signal is sent; whereas when paddle button 20 is pressed for more than a first predetermined amount of time, a second signal is sent.

As a first example of this arrangement, when the up zone 22 is pressed for less than ⅓ of a second, a first signal is sent which is a signal that jogs the shade up to the next predetermined position; whereas when the up zone 22 is pressed for more than ⅓ of a second, a second signal is sent which is a signal that moves the shade to the open position.

As a second example of this arrangement, when the down zone 24 is pressed for less than ½ of a second, a first signal is sent which is a jog down to next predetermined position signal; whereas when the down zone 24 is pressed for more than ½ of a second, a second signal is sent which is a move to closed position signal. As a third example of this arrangement, when the middle zone 26 is pressed for less than ¾ of a second, a first signal is sent which is a move to 25% closed position; whereas when the middle zone 26 is pressed for more than ¾ of a second, a second signal is sent which is a move to 75% closed position. In this arrangement, pressing the button for a predetermined amount of time means to continuously depress the button such that sensor 70 senses the button has been continuously depressed.

Three-Signals:

In one arrangement, when paddle button 20 is pressed for less than a first predetermined amount of time, a first signal is sent; whereas when paddle button 20 is pressed for more than a first predetermined amount of time and less than a second predetermined amount of time, a second signal is sent; whereas when paddle button 20 is pressed for more than a second predetermined amount of time, a third signal is sent.

As a first example of this arrangement, when the up zone 22 is pressed for less than ⅓ of a second, a first signal is sent which is a jog up to next predetermined position signal; whereas when the up zone 22 is pressed for more than ⅓ of a second and less than 1 second, a second signal is sent which is a move up to the next major demarcation position such as 25% open, 50% open or 75% open; whereas when the up zone 22 is pressed for more than 1 second, a third signal is sent which is full open signal.

As a second example of this arrangement, when the down zone 24 is pressed for less than ½ of a second, a first signal is sent which is a jog down to next predetermined position signal; whereas when the down zone 24 is pressed for more than ½ of a second and less than ¾ of a second, a second signal is sent which is a move down to the next major demarcation position such as 25% closed, 50% closed or 75% closed; whereas when the down zone 24 is pressed for more than ¾ of a second, a third signal is sent which is a full close signal.

As a third example of this arrangement, when the middle zone 26 is pressed for less than ⅕ of a second, a first signal is sent which is a move to closest predetermined major demarcation position such as 25% closed, 50% and 75% closed; whereas when the middle zone 26 is pressed for more than ⅕ of a second and less than ⅘ of a second, a second signal is sent which is a move to the second closest predetermined major demarcation position such as 25% closed, 50% and 75% closed; whereas when the middle zone 24 is pressed for more than ¾ of a second, a third signal is sent which is a move to the third closest predetermined, major demarcation position such as 25% closed, 50% and 75% closed.

Any combination can exist to provide improved control of architectural coverings. In one arrangement, the up and down zones 22, 24 can have a two position arrangement as is described herein whereas the middle zone has a three position arrangement as is described herein.

The first and second predetermined amount of time can be any amount of time such as a fraction of a second to multiple seconds. As examples, the predetermined amount of time includes 1/10, 1/9, 1/8, 1/7, 1/6, 1/5, 1/4, 1/3, 1/2, 2/3, 3/4 of a second or 1 second or more.

Groups:

As is described herein, remote 10 includes a multichannel functionality. When the select button 28 is pressed in a multi-function remote, the remote toggles or changes channels, which is indicated by indicators 30. Each channel, and therefore, each indicator 30, is intended and assigned to either a single architectural covering or a group of architectural coverings. For purposes herein, a group of architectural coverings is defined as one or more or a plurality of architectural coverings that respond to the same wireless signal, or are controlled simultaneously with one another.

As a first example, a house equipped with motorized architectural coverings of the type controlled by remote 10 in the bedroom (Group 1) the family room (Group 2), the kitchen (Group 3), and the office (Group 4). When a user wants to control a specific one of these groups, the user toggles through the channels to select the proper group by depressing the select button 28 until the proper indicator 30 is illuminated, the first light corresponding with Group 1, the second light corresponding with Group 2, the third light corresponding with Group 3, the fourth light corresponding with Group 4 and the fifth light corresponding with all Groups 1-4. When a user selects one of these groups and then presses another button, the signal sent activates all of the architectural coverings assigned or grouped into the selected group.

As a second example, an office is equipped with four motorized architectural coverings. Each of these architectural coverings are assigned to their own group, Groups 1-4. All the architectural coverings are assigned into the all group or Group 5. In this example, when the user wants to control any one of the architectural coverings they select the proper channel for that architectural covering, at which point signals are sent to control only that single architectural covering. When the user wants to simultaneously control all architectural coverings in the office, the fifth channel is selected, at which point all the architectural coverings are controlled simultaneously.

Any other arrangement of groups is hereby contemplated.

Scenes Buttons:

In one arrangement, the push buttons 18 are assigned to specific aesthetic scenes for the channel or group selected.

As one example, the upper most button 18 corresponds with an open position, the bottom most button 18 corresponds with a closed position, the middle two buttons correspond with a 25% closed position and a 25% open position. That is, when upper most button 18 is depressed, all architectural coverings associated with the selected channel open; when bottom most button 18 is depressed, all architectural coverings associated with the selected channel close; when second to the top button 18 is depressed, all architectural coverings associated with the selected channel move to a 25% closed position; when second to the bottom button 18 is depressed, all architectural coverings associated with the selected channel move to a 25% open position.

As a second example, when a scene button is depressed, not all of the architectural coverings are moved to the same position. In an arrangement where there are architectural coverings on an east wall, a south wall and a west wall in an office. When the first scene is depressed, the architectural coverings on the east wall are fully closed whereas the other architectural coverings are fully opened. This corresponds to an early morning condition wherein the light streams through the east windows. When the fourth scene button is depressed, the architectural coverings on the west wall are fully closed whereas the other architectural coverings are fully opened. This corresponds to an afternoon condition wherein the light streams through the west windows. When the second scene button is depressed all south architectural coverings move to a 75% closed position, the east architectural coverings move to a 25% closed position and the west architectural coverings move to an open position. When the third scene button is pressed all of the architectural coverings move to a 50% open condition. In this way a plurality of architectural coverings are controlled with a single press of a button.

In addition to controlling architectural coverings, remote 10 also controls other electronic devices such as TV's, lights, locks, audio systems, and the like. As such, control of these components is also included in the scene buttons.

As one example, the first scene button is associated with an open for business condition, wherein all the architectural coverings are opened and all the electronic components, such as lights and TV are turned on. The fourth scene button is associated with a closed for business condition, wherein all the architectural coverings are closed and all the electronic components are turned off. The second scene button is associated with a romantic setting wherein the window coverings are closed half way and the lights are dimmed. The third scene button is associated with a second romantic setting wherein the window coverings are fully closed and the lights are dimmed.

Hotel Example:

In another example, with reference to FIG. 2, the remote depicted in FIG. 2 is a single channel remote for use in a room having a window having a motorized drapery 46 lights and a TV which are also wirelessly controlled. When the select button 28 is depressed for less than a predetermined amount of time the drapery 46 is opened, the lights are turned on and the TV is turned on. When the select button 28 is depressed for more than a predetermined amount of time the drapery 46 is closed, the lights are turned off and the TV is turned off. From the above discussion and the accompanying drawings and claims it will be appreciated that the system and method of using remote controls to manipulate architectural coverings presented offers many advantages over the prior art. That is the system presented is easy to use; is efficient; is simple in design; is inexpensive; has a minimum number of parts; has an intuitive design; provides for storage of remote controls in an aesthetically pleasing manner; provides improved functionality; improves the accuracy of control; has a minimum number of buttons; provides a convenient and secure place to hold the remote; utilizes standard parts and components where possible, among countless other objects, features and advantages.

It will be appreciated by those skilled in the an that other various modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in light thereof will be suggested to persons skilled in the art and are to be included within the spirit and purview of this application.

What is claimed:

1. A remote control for an architectural covering comprising:

a remote having a first paddle button;

the first paddle button having an elongated body with a first zone and a second zone;

wherein when the first zone is pressed for a less than a predetermined amount of time, a first signal is sent;

wherein when the first zone is pressed for more than a predetermined amount of time, a second signal is sent;

wherein when the second zone is pressed for a less than a predetermined amount of time, a third signal is sent;

wherein when the second zone is pressed for more than a predetermined amount of tune, a fourth signal is sent;

the remote having a second paddle button;

wherein the first paddle button controls a blackout curtain of a drapery and the second paddle button controls a sheer curtain.

2. The remote control for an architectural covering of claim 1 wherein the first paddle button is positioned in vertical alignment with the body of the remote.

3. The remote control for an architectural covering of claim 1 wherein the first signal is a jog open signal.

4. The remote control for an architectural covering of claim 1 wherein the second signal is an open signal.

5. The remote control for an architectural covering of claim 1 wherein the third signal is a jog closed signal.

6. The remote control for an architectural covering of claim 1 wherein the fourth signal is a close signal.

7. The remote control for an architectural covering of claim 1 further comprising a plurality of scene buttons.

8. The remote control for an architectural covering of claim 1 further comprising a channel select button which when activated toggles through a plurality of channels.

9. The remote control for an architectural covering of claim 1 further comprising a plurality of indicator lights which indicate a selected channel.

10. The remote control for an architectural covering of claim 1, wherein the first paddle button and second paddle button are positioned in horizontal alignment with the body of the remote.

11. A system for wirelessly controlling an architectural covering comprising:

a motorized architectural covering having first shade material which extends an operating range between an open position and a closed position;

wherein the operating range is divided into a plurality of jog positions;

wherein a unique jog signal is assigned to the unique jog positions in the operating range;

a remote control having a first open jog button and a first close jog button associated with the first shade material;

wherein when the first open jog button is pressed the remote control transmits the unique jog signal associated with the next jog position in an open direction;

wherein when the first closed jog button is pressed the remote control transmits the unique jog signal associated with the next jog position in a close direction, the motorized architectural covering having second shade material which extends an operating range between an open position and a closed position; and the remote control having a second open jog button and a second close job button associated with the second shade material.

12. The system of claim 11 wherein the first open jog button and first close jog button are combined into an elongated paddle button.

13. The system of claim 11 wherein the last position of the architectural covering is stored in memory of the remote control or memory of the architectural covering.

14. The system of claim 11 wherein when the first open jog button or the first close jog button is pressed for more than a predetermined amount of time an open signal or a closed signal is transmitted.

15. The system of claim 11 wherein adjacent jog positions are separated by a predetermined distance.

16. The system of claim 11 wherein adjacent jog positions are separated by a predetermined percentage of distance between the open position and the closed position.

* * * * *